US012522996B2

(12) United States Patent
Steffen

(10) Patent No.: US 12,522,996 B2
(45) Date of Patent: Jan. 13, 2026

(54) SOIL COMPACTING DEVICE HAVING AN ELECTRIC DRIVE

(71) Applicant: Wacker Neuson Produktion GmbH & Co. KG, Reichertshofen (DE)

(72) Inventor: Michael Steffen, Munich (DE)

(73) Assignee: Wacker Neuson Produktion Gmbh & Co. KG, Reichertshofen (DE)

( * ) Notice: Subject to any disclaimer, the term of this patent is extended or adjusted under 35 U.S.C. 154(b) by 563 days.

(21) Appl. No.: 17/984,582

(22) Filed: Nov. 10, 2022

(65) Prior Publication Data

US 2023/0140885 A1 May 11, 2023

(51) Int. Cl.
*E02D 3/074* (2006.01)

(52) U.S. Cl.
CPC ..... *E02D 3/074* (2013.01); *E02D 2600/20* (2013.01)

(58) Field of Classification Search
CPC ..... E02D 3/074; E02D 2600/20; E01C 19/38; E01C 19/35; H02K 1/2706
See application file for complete search history.

(56) References Cited

U.S. PATENT DOCUMENTS 7,682,102 B1 * 3/2010 Burke ..... E01C 19/35 404/133.05
8,708,599 B2 * 4/2014 Steffen ..... E01C 19/34 404/133.05
9,175,447 B2 * 11/2015 Steffen ..... E01C 19/35
2006/0165488 A1 * 7/2006 Morris ..... E02D 3/046 404/133.1
2008/0252150 A1 * 10/2008 Grundl ..... H02K 33/16 310/12.24
2010/0296869 A1 * 11/2010 Catanzarite ..... E01C 19/35 29/428
2011/0097149 A1 * 4/2011 Steffen ..... E02D 3/074 404/75
2015/0167259 A1 * 6/2015 Steffen ..... E01C 19/38 74/44
2023/0049127 A1 * 2/2023 Glanzer ..... E01C 21/00

FOREIGN PATENT DOCUMENTS

DE 629006 C * 12/1933
DE 102010052243 A1 * 5/2012 ..... E02D 3/046
DE 10 2010 055 632 6/2012
DE 102010055632 A1 * 6/2012 ..... E01C 19/34
DE 202013005537 U1 * 8/2013 ..... E01C 19/35
(Continued)

*Primary Examiner* — Jamie L Mcgowan
(74) *Attorney, Agent, or Firm* — Boyle Fredrickson, S.C.

(57) ABSTRACT

A soil compacting device includes an upper mass and a lower mass which is coupled to the upper mass by a spring. The lower mass is movable relative to the upper mass and comprises a ground contact element for soil compaction. A drive for generating a working movement of the ground contact element is provided on the upper mass, the drive has a tamping device and an electric motor for driving the tamping device. The tamping device has a crank wheel that can be driven in rotating manner by the electric motor, a connection rod coupled to the crank wheel, and a tamping piston which can be moved in reciprocating fashion and is coupled to the connection rod and which interacts with the spring. The electric motor has a stator and a rotor. The rotor is rigidly or elastically coupled to the crank wheel.

15 Claims, 8 Drawing Sheets

(56) References Cited

FOREIGN PATENT DOCUMENTS

| | | | | | |
|---|---|---|---|---|---|
| DE | 10 2013 020 857 | | | 6/2015 | |
| DE | 102014009375 | A1 | * | 12/2015 | ..... B25D 11/125 |
| EP | 0340029 | A2 | * | 4/1989 | |
| EP | 2434053 | A2 | * | 3/2012 | ..... E01C 19/35 |
| EP | 2884005 | A1 | * | 6/2015 | ..... E01C 19/35 |
| EP | 4174235 | A1 | * | 5/2023 | ..... E01C 19/34 |
| EP | 4345211 | A1 | * | 4/2024 | ..... E01C 19/35 |
| SE | 410873 | B | * | 11/1979 | |
| WO | WO-2012084074 | A1 | * | 6/2012 | ..... E01C 19/34 |

* cited by examiner

SOIL COMPACTING DEVICE HAVING AN ELECTRIC DRIVE

BACKGROUND OF THE INVENTION

1. Field of the Invention

The invention relates to a soil compacting device with an electric drive.

2. Description of the Related Art

Such a soil compacting device, in particular a so-called vibration tamper or vibrotamper, is widely known and is used for compacting soil and asphalt layers. The tampers are driven in many ways by internal combustion motors, e.g., two-stroke motors. It is also known to provide electric drive motors.

In an electric drive, the electric motor is usually operated at a higher speed and, via a reduction gear, drives a spring-mass system that serves as a tamping system. The electric drive motor is fed either from the electrical power supply or from rechargeable batteries that are carried along.

The electric drive motors have a stator and a rotor. Asynchronous machines with squirrel-cage rotors and brushless direct current motors (BLDC motors) have proven to be suitable.

Due to the design of the drive motors and the mode of operation of a vibration tamper, a reduction gear is required to adapt the speeds (tamping frequency) required by the tamping system. Such a gear requires installation space and additional components. In addition, it reduces the efficiency of the drive, which has a disadvantageous effect primarily due to the limited electrical capacity of the rechargeable batteries that can be used.

FIG. 1 shows an example of a vibration tamper known from the prior art, comprising an upper mass 1 and a lower mass 2 that is movable relative to the upper mass 1 and is coupled to the upper mass 1 via a spring mechanism or simply spring 3. Spring 3 supports a spring-mass system, in which a forced movement introduced via upper mass 1 causes a spring-action tamping movement of a ground contact plate 4 provided on lower mass 2.

An electric motor 5 is provided on upper mass 1 and drives a crank wheel 7 in a rotating manner via a reduction gear 6. A crank pin 8 is provided on the crank wheel 7 and is coupled to a connection rod 9. Connection rod 9 in turn is coupled to a tamping piston 10, the end of which interacts with the spring 3 in a manner known per se.

A handle 11, for example, a handlebar, is attached to upper mass 1 via a vibration decoupling 12, for example, rubber buffers. An operator can guide the vibration tamper with his/her hands on the handle 11.

An energy storage in the form of a rechargeable battery 13 is attached to handle 11.

In the embodiment of a conventional vibration tamper shown in FIG. 1, the rechargeable battery 13 is coupled to electric motor 5, not only in order to route the electrical leads to electric motor 5, but also to guide a flow of cooling air over rechargeable battery 13 and electric motor 5. The flow of cooling air can be generated by a blower, not shown, for example by a fan provided on electric motor 5.

In order to be able to accommodate the various components on the tamper, the drive motor must generally be arranged outside of the tamper axis, so that tilting moments occur as a result during operation of the tamper, decreasing the effectiveness of the tamper and downgrading the controllability.

SUMMARY OF THE INVENTION

The underlying object of the invention is to specify a soil compacting device that serves as a vibration tamper, which enables a particularly compact construction with the smallest possible number of components.

The object is achieved according to the invention by a soil compacting device having an upper mass and a lower mass which is coupled to the upper mass by a spring and which is movable relative to the upper mass and comprises a ground contact element for soil compaction. A drive for generating a working movement of the ground contact element is provided on the upper mass. The drive has a tamping device and an electric motor for driving the tamping device. The tamping device has: a crank wheel that can be driven in rotating manner by the electric motor, a connection rod coupled to the crank wheel, and a tamping piston which can be moved in reciprocating fashion and is coupled to the connection rod and which interacts with the spring. The electric motor has a stator and a rotor which is rigidly or elastically coupled to the crank wheel.

Thus, the rotor and the crank wheel virtually form a unit. A relative rotation between the rotor and the crank wheel is not possible, apart from permissible elasticities, for example, in the case of an elastic coupling. There is also no gear interposed between the rotor and the crank wheel, in particular no reduction gear, as is required in the prior art.

The electric motor can be a reluctance machine, in particular a synchronous reluctance machine. A synchronous reluctance machine with a segmented stator has proven to be particularly suitable, in which the stator only extends over a specific angular range (stator block).

Due to the direct coupling of rotor and crank wheel, the intermediate reduction gear otherwise interposed can be dispensed with, so that a significant number of components can be eliminated. With an appropriate design of the electric motor, it is possible to operate the electric motor at a low speed, which is already suitable for the tamping process and the desired tamping frequency. Accordingly, the electric motor must provide sufficient torque at this low speed in order to be able to carry out the tamping process powerfully. A reluctance machine is particularly suitable for this purpose.

The omission of the reduction gear enables a particularly compact construction of the soil compacting device, which also allows a favorable weight or mass distribution of the components. With a corresponding configuration of the electric motor and the tamping device, it is possible that the center of gravity of the electric motor is arranged on the tamping axis, i.e., on the longitudinal axis of the movement of the lower mass and the tamping piston. There is then no leverage between the movement of the lower mass and the center of gravity of the electric motor. As a result, undesired tilting moments can be avoided during operation of the tamper.

The rotor can be formed on the circumference of the crank wheel. In this embodiment, the rotor is virtually replaced by the crank wheel, or it becomes part of the crank wheel. In this way, the rotor and crank wheel can be integrated to form one part. In this case, the rotor can be arranged radially on the outside on the circumference of the crank wheel. Crank wheel and rotor form a unit, so that the rotor can take over the function of the crank wheel, i.e., in particular driving or moving the connection rod. A classic motor shaft for connecting the rotor and crank wheel can thus be dispensed with.

The outer circumference of the crank wheel must be suitably configured in order to be used as a rotor.

The rotor can thus have a plurality of rotor poles, which can be arranged on the circumference of the crank wheel.

The rotor poles can be laminated, i.e., form a laminated core of stacked laminations. For electromagnetic reasons, laminated structures are to be provided for the rotor, so that the rotor poles and the pole wheel formed thereby are formed by stacked laminations.

The rotor poles can be laminated together with the crank wheel. That means, that the rotor poles and the crank wheel together consist of stacked laminations. A lamination can, for example, comprise the contour of the rotor poles on the circumference and of the crank wheel on the inside. By stacking and assembling the laminations, the rotor with the rotor poles and the crank wheel are formed. The laminations can be held together in a suitable manner, for example, by means of pin connections (press fits) or screw connections.

In one variant, the crank wheel can be embodied without laminations and can carry the laminated rotor poles, i.e., the laminated magnet wheel, on its circumference. Accordingly, the crank wheel can be embodied solid, for example, as a turned part (steel turned part or cast turned part). It serves as a carrier for the rotor with the rotor laminations and carries the stacked laminations for the rotor poles on the circumference. Accordingly, the laminated core ring is fastened to the circumference of the crank wheel.

The stator can enclose the rotor over an angle of less than 360°. In this variant, the motor stator can no longer be embodied as a closed rotary part or as a closed ring, but can only extend over a specific angular range. Accordingly, the stator can be embodied as a stator segment or stator block and extend over an angle of, for example, 270° or less, 180° or less, 120° or less or 90° or less.

Accordingly, it is also possible to distribute several stator segments or stator blocks on the circumference of the rotor, as a result of which the performance of the motor and in particular the torque of the motor can be increased.

In an intended working position of the soil compacting device, the stator can be arranged above the rotor. For example, the stator can be held in the motor cover or in the cover of the drive housing or crankcase. In this case, it does not have to form a structural unit with the rotor. In particular, the stator and rotor do not have to be accommodated separately from the crank wheel in a common electromotor housing. Rather, the stator, the rotor and the crank wheel can be arranged in a common housing or separately from one another.

In one variant, at least two crank wheels can be provided, on the circumference of each of which a rotor is provided, with the connection rod being driven jointly by the two crank wheels. Accordingly, several rotors and stators can also be provided in this embodiment, as a result of which a particularly powerful drive of the tamping device is possible.

In particular, the two crank wheels and the associated rotors can be aligned coaxially in order to be able to drive the connection rod in the desired manner.

At least part of the drive may be enclosed by a drive housing, wherein an airflow generating device may be provided for generating a flow of cooling air within the drive housing to cool the rotor and the stator. Accordingly, the drive housing can also be considered to be a crankcase or a motor housing, with the stator, the rotor, the crank wheel and at least part of the connection rod and possibly also part of the tamping piston being accommodated inside the drive housing.

Using the air flow generating device, it is possible to generate a flow of cooling air inside the drive housing and thus to dissipate heat from the rotor and stator, but possibly also from the tamping device.

The air flow generating device can have at least one of the following operating principles: An air pump effect can be generated by the movement of the tamping piston for generating the flow of cooling air, or: on the rotor at least one fan blade can be provided for generating the flow of cooling air. The tamping piston on the one hand and the rotor on the other hand thus have effective surfaces that specifically generate an air movement that can form or support the desired flow of cooling air.

An air inlet for the inflow of air from the environment and an air outlet for releasing air to the environment can be provided on the drive housing, wherein a check valve can be provided in the air inlet for setting an air flow direction from the environment into the drive housing, and wherein a check valve can be provided in the air outlet for setting an air flow direction from the drive housing into the environment.

The check valve is therefore a directional valve that allows air to flow only in one direction, namely either into the drive housing via the air inlet or out of the drive housing via the air outlet. The check valve can have, for example, a rubber flap-like element which, depending on the direction of the air flow, opens or closes a relevant opening.

In connection with the pumping action when the tamping piston is moving and thus a change in the air volume inside the drive housing, fresh air from the environment can be sucked into the drive housing via the air inlet, and with a compressing action of the tamping piston can be expelled via the air outlet. As a result, a constant exchange of air in the interior of the drive housing and thus a cooling effect can be achieved.

A motor controller be provided for controlling the electric motor in such a way that the speed of the rotor and thus the speed of the crank wheel is variable over one or more revolutions of the rotor. The motor controller is thus used for a targeted change in the speed and thus in the torque. This change is therefore based not only on a reaction of the tamping system and thus of the soil to be compacted, but on a targeted activation by the motor controller.

In this way, a variation of the movement of the tamping foot is possible, which, e.g., can be utilized to dynamize the tamping process, but can also be used to quiet the machine. For example, in cases where the tamping device jumps onto a hard ground, the drive power of the motor can be reduced, and the tamping device can thereby be quieted.

It is also possible to apply a double impact of the tamping device to the soil to be compacted by briefly increasing the speed. This can also result in the recoil forces acting on the operator operating the tamping device being able to be reduced, with high tamping energy at the same time.

The motor controller can also be used to scale the torque to apply impact of different intensities to the ground.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

These and other advantages and features of the invention are explained in more detail below using examples with the aid of the accompanying figures. In the figures.

DETAILED DESCRIPTION

Figure 1:
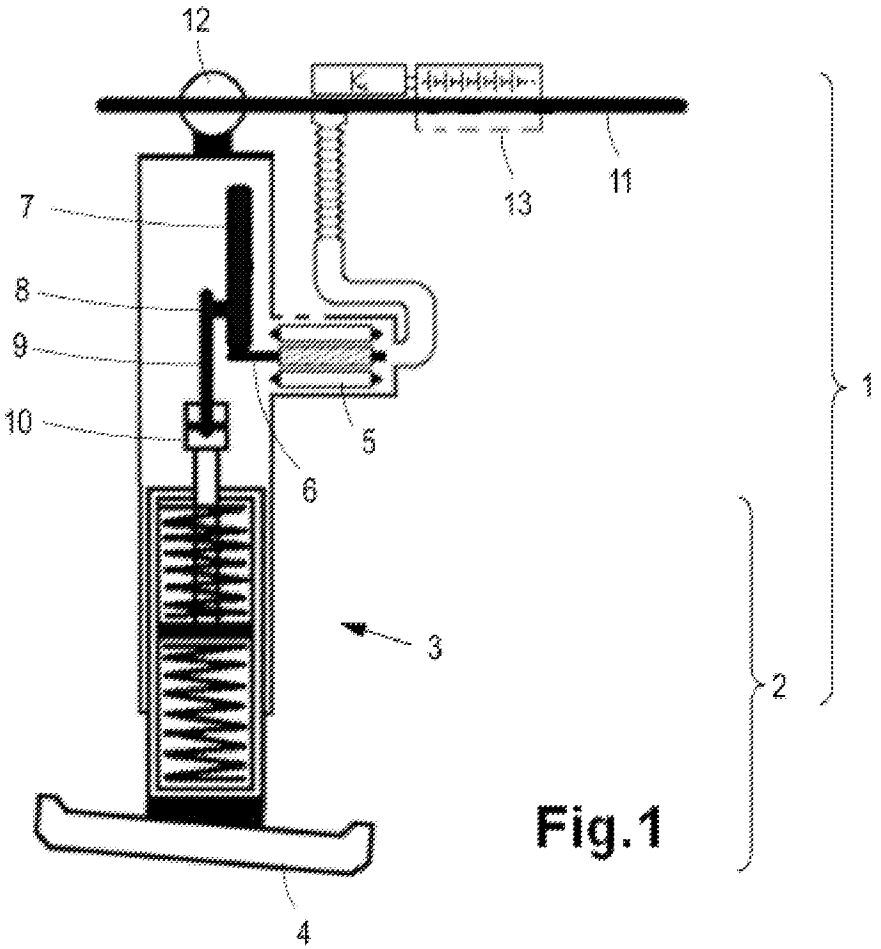
Prior Art Fig.1
FIG. 1 shows a vibration tamper known from the prior art as a soil compacting device.
Figure 2:
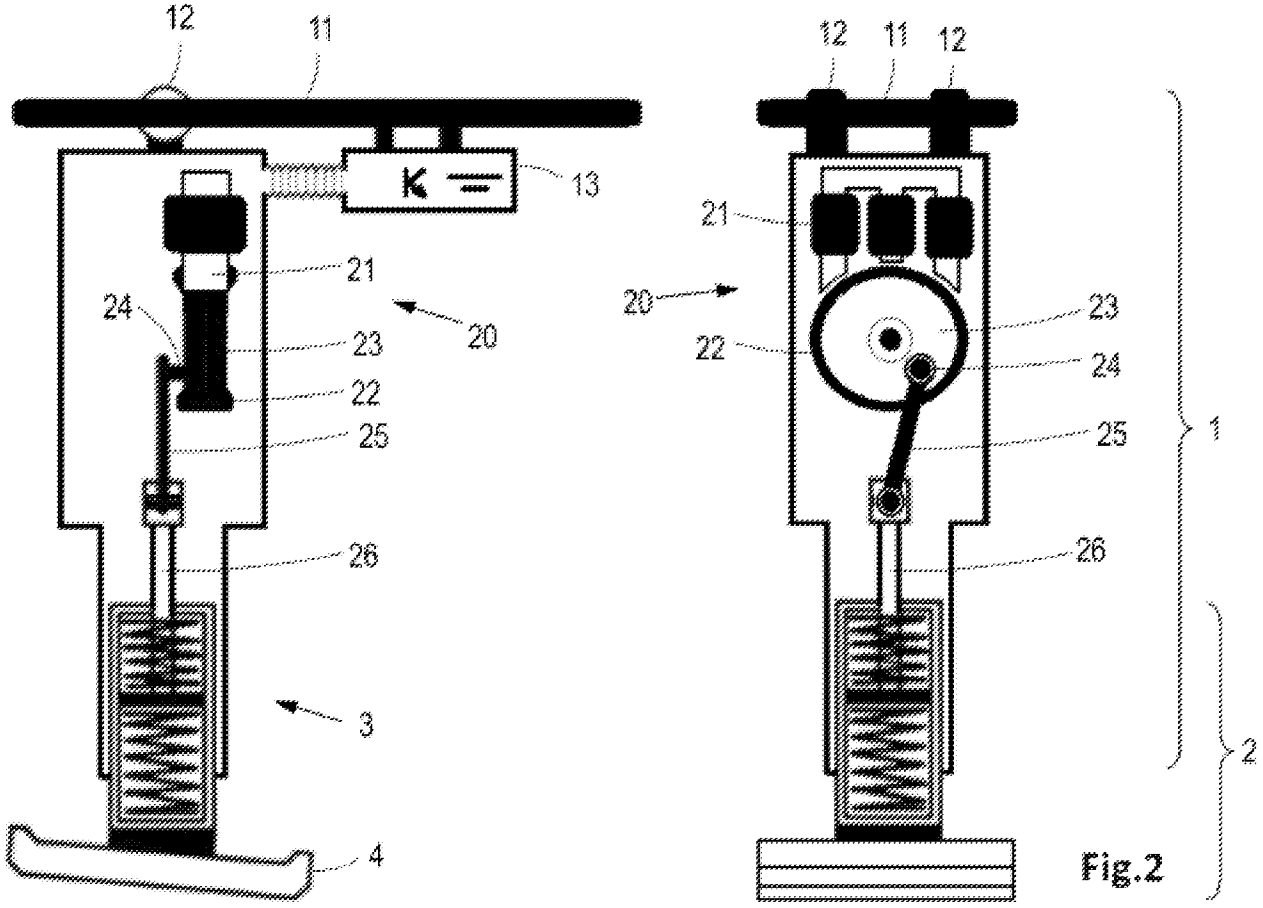
FIG. 2 shows a vibration tamper as a soil compacting device according to an embodiment the invention in a sectional side view and front view

FIG. 2 shows a vibration tamper as a soil compacting device according to the invention, in a lateral sectional view in the left part of the picture and in a sectional front view in the right part of the picture. As far as components correspond functionally to the components of the vibration tamper of FIG. 1 explained above in connection with the prior art, the same reference numerals are used.

Accordingly, the vibration tamper has an upper mass 1 and a lower mass 2 that is movable relative to the upper mass 1 and is coupled to the upper mass 1 via a mechanism, or simply, spring controller 3. Spring controller 3 supports a spring-mass system, in which a forced movement (linear reciprocating movement of the tamping piston) initiated via upper mass 1 causes a spring-action tamping movement of a ground contact plate 4 provided on lower mass 2.

A handle controller 11, e.g., a handlebar, is attached to upper mass 1 via a vibration decoupling controller 12, for example rubber buffers. An operator can guide the vibration tamper with his/her hands on handle controller 11. An energy storage controller in the form of a rechargeable battery 13 is attached to handle controller 11.

Inside upper mass 1, provision is made for an electric motor 20, comprising a stator 21 and a rotor 22. Electric motor 20 is embodied as a synchronous reluctance machine, with stator 21 being a segmented stator, which only extends over a range of approximately 90°, as can be seen in the right-hand part of FIG. 2. As a result, an uninterrupted circumferential gap extends between opposed ends of the are formed by the stator 21. The arc length of that gap is approximately 270° in the example illustrated in the right hand of FIG. 2 in which the are length of the stator 21 is approximately 90%. Naturally, the arc length of the gap would be approximately 180° or more if the stator extended through an are of approximately 180° or less.

Rotor 22 is arranged on the outer circumference of a crank wheel 23. In this way, crank wheel 23 is an integral part of electric motor 20 and is driven directly by it without a gear being interposed.

Rotor 22 can be designed slightly wider than the thickness of crank wheel 23, as can be seen in the left-hand part of FIG. 2, where rotor 22 slightly arches over crank wheel 23.

Crank wheel 23 drives a connection rod 25 via a crank pin 24, which connection rod 25 in turn causes a tamping piston 26 to move in a linear reciprocating fashion in a manner known per se. Tamping piston 26 interacts with spring controller 3 in order to achieve a spring-action tamping movement of ground contact plate 4 from the guided reciprocating movement of tamping piston 26.

Rechargeable battery 13 is also provided on upper mass 1 on handle controller 11, which is connected to upper mass 1 via vibration decoupling device 12. Rechargeable battery 13 serves to supply electric motor 20 with energy.

Rotor 22 is embodied in laminated fashion and, accordingly, has a laminated core which is fastened to or carried by crank wheel 23, which is embodied, for example, as a rotary part or a forged part. In one variant, it is possible that rotor 22 and crank wheel 23 are formed together by stacked sheet metals, i.e., they are embodied in a laminated fashion.

Figure 3:
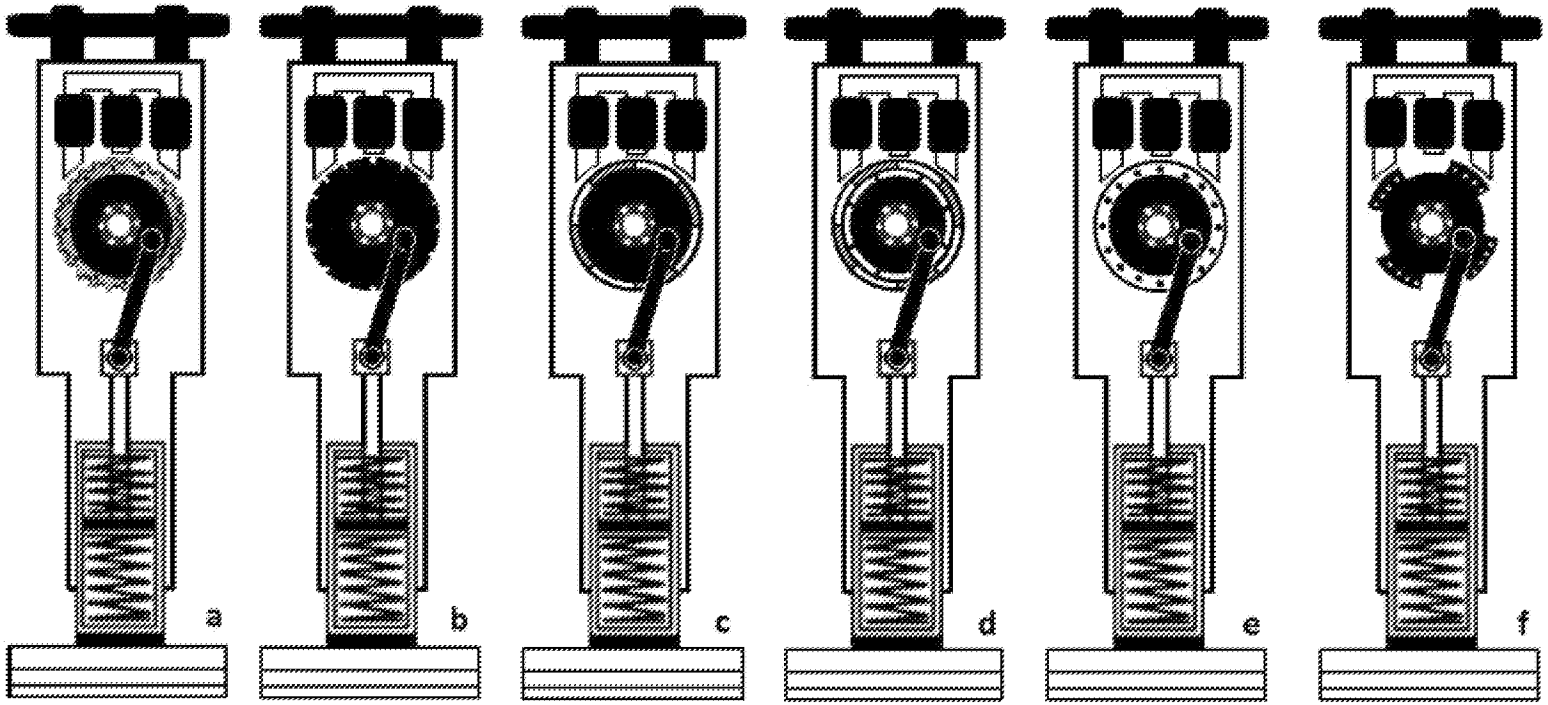
FIG. 3 shows different variants of a vibration tamper according to an embodiment of the invention in a sectional front view.

FIG. 3 shows different variants of the tamper from FIG. 2, each with differently configured rotors 22 with differently configured rotor poles. In particular, it can be seen in the different variants a to f of FIG. 3 that the rotors have different numbers of rotor poles.

Figure 4:
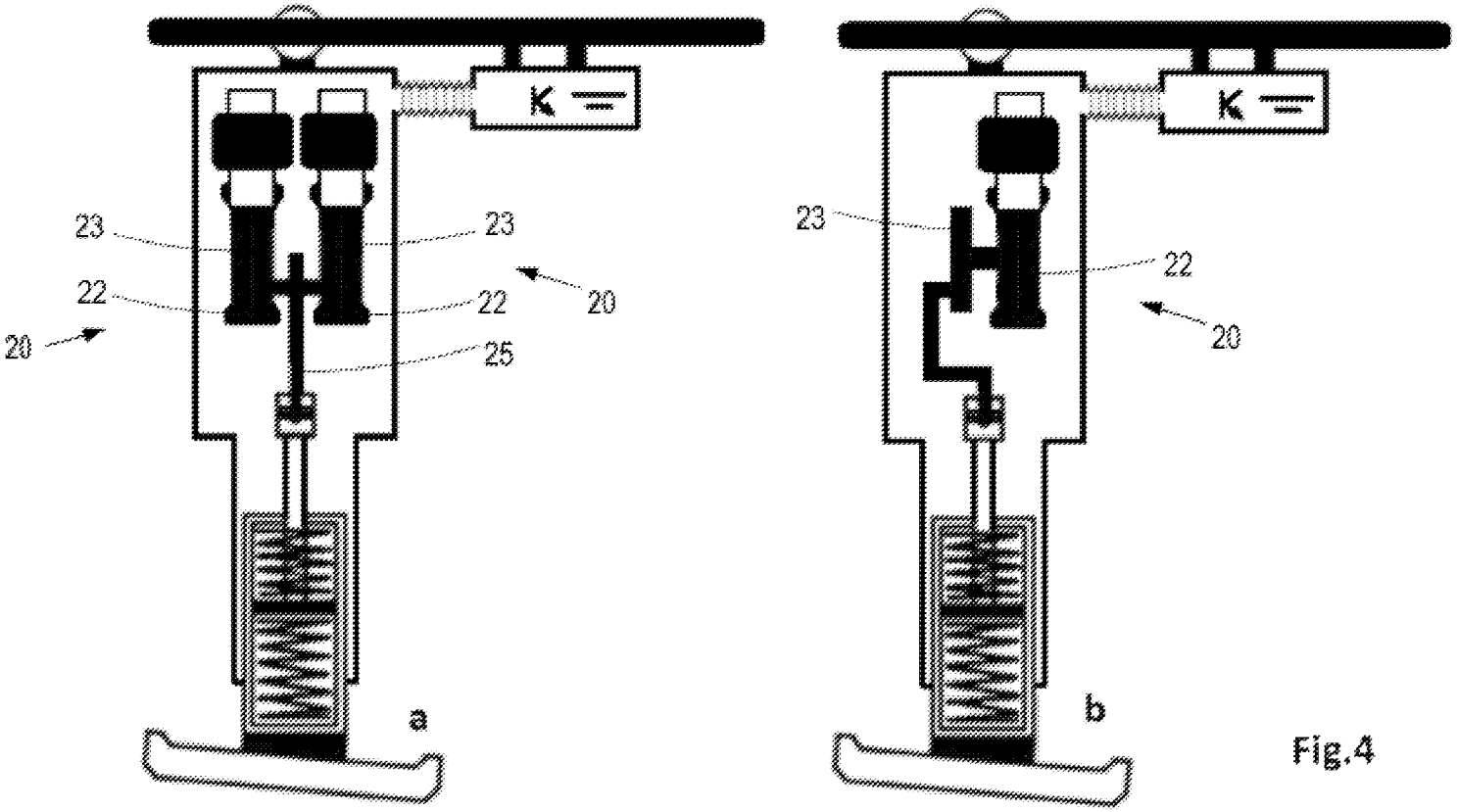
FIG. 4 shows further variants of a vibration tamper according to embodiments of the invention.

In particular, the different variants have the following features:

- a: combination crank wheel with synchronous reluctance ring motor
- b: synchronous reluctance rotor as a crank wheel
- c: crank wheel with magnets arranged on the circumference
- d: crank wheel with magnets arranged on the circumference and/or on the inside
- e: crank wheel as an asynchronous motor rotor; also, possible as a combination
- f: salient poles in asynchronous, magnetic or synchronous reluctance motors In the left-hand part a, FIG. 4 shows a variant in which two crank wheels 23 are driven by rotors 22 arranged on the circumference. Accordingly, two electric motors 20 arranged coaxially to one another are provided. Crank wheels 23 drive jointly connection rod 25. A particularly compact and powerful drive can be implemented due to the double motor arrangement.

In the variant of FIG. 4*b*, rotor 22 is arranged axially offset with respect to crank wheel 23. This allows the weight distribution along the tamping axis to be optimally designed.

Figure 5:
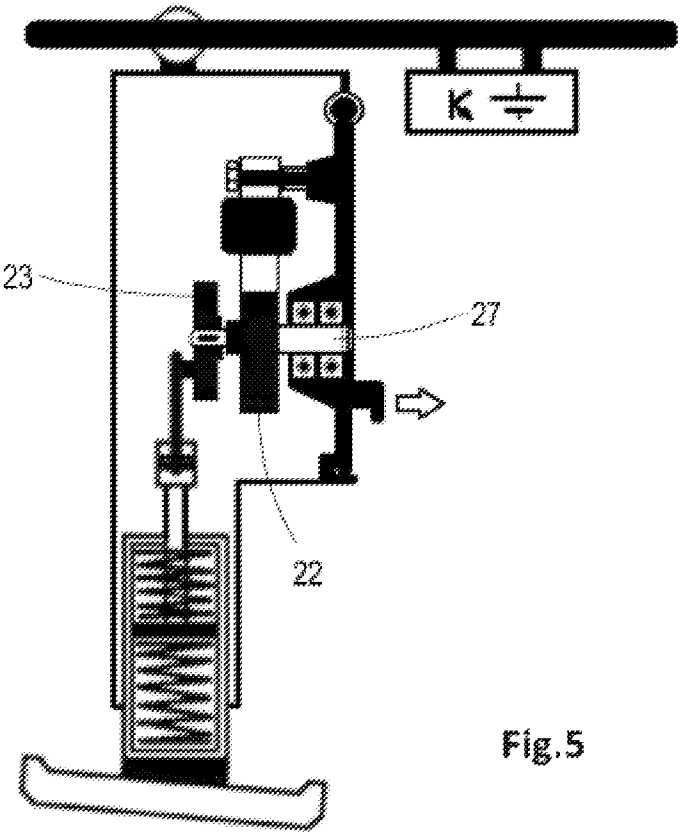
FIG. 5 shows a variant of a vibration tamper with a rigid coupling of rotor and crank wheel.

FIG. 5 shows another embodiment as a variant to that of FIG. 4*b*. Here, rotor 22 and crank wheel 23 are arranged coaxially on a common shaft 27 and coupled to one another by a shaft-hub connection (here: feather key connection) in a form-fitting manner at least in the circumferential direction.

Figure 6:
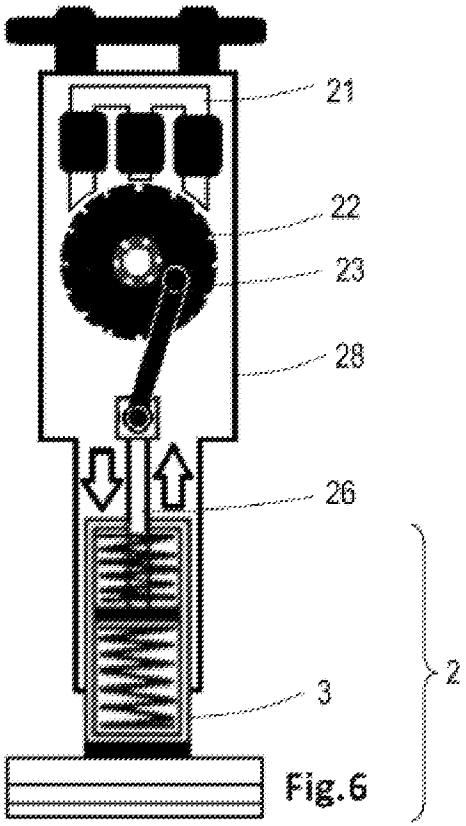
FIG. 6 shows a vibration tamper with an air flow generating device.

FIG. 6 shows a vibration tamper similar to that of FIG. 2.

In addition, it is illustrated that tamping piston 26 together with spring controller 3 forms a kind of air pump, which compresses and decompresses at intervals the air inside a drive housing 28 enclosing electric motor 20, crank wheel 23 and parts of the tamping device.

The air is moved inside drive housing 28 as a result of the alternating compression and relief, as a result of which a flow of cooling air is created, which cools the components of electric motor 20.

Figure 7:
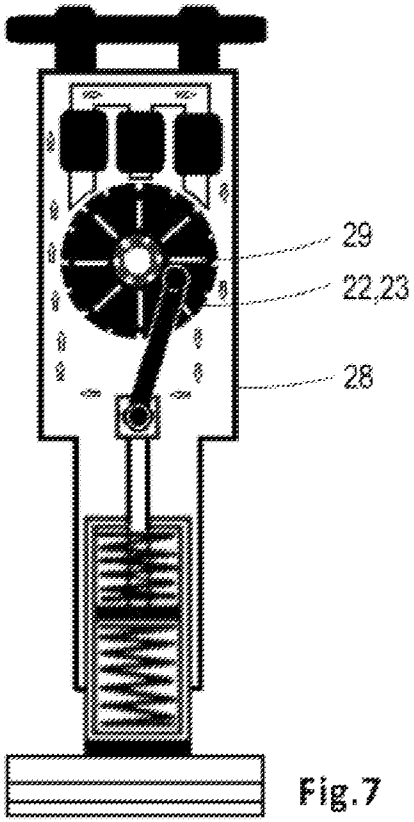
FIG. 7 shows a variant of an air flow generating device.

FIG. 7 shows another embodiment with an air flow generating device having fan blades 29, which are arranged on rotor 23 and crank wheel 23, respectively. Due to the rotation of rotor 22 and crank wheel 23, the air inside the drive housing 28 is circulated, resulting in a cooling effect.

Figure 8:
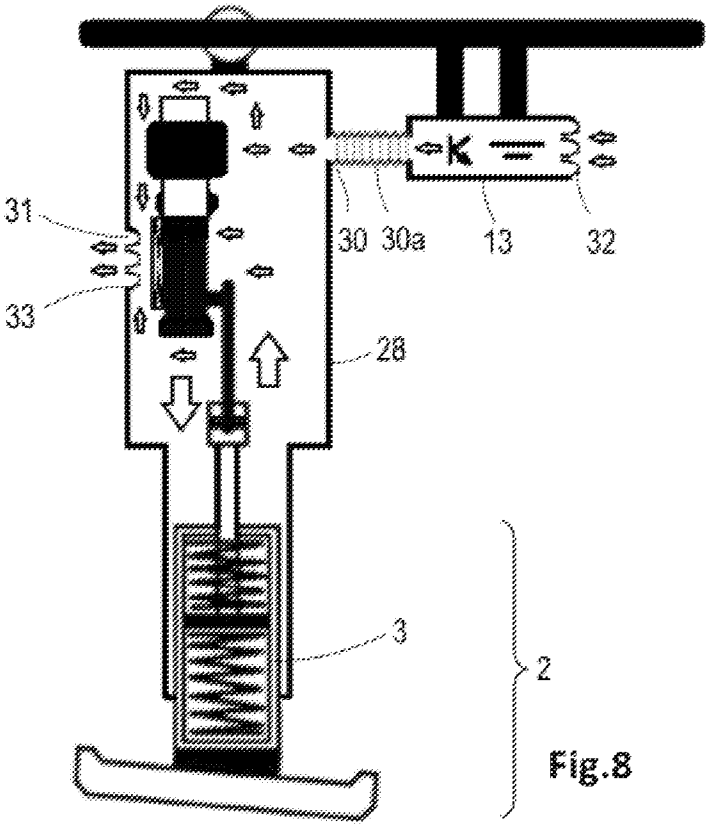
FIG. 8 shows another embodiment of an air flow generating device.

FIG. 8 shows a further variant of the air flow generating device.

The principle is based on the illustration in FIG. 6, so that the linear movement of lower mass 2 with spring controller 3 achieves a pumping effect inside drive housing 28. Drive housing 28 has an air inlet 30 and an air outlet 31. Air inlet 30 communicates with a first check valve 32 (inlet check valve 32) via an air duct 30*a*. An outlet check valve 33 is provided at air outlet 31.

FIG. 8 also shows that air is guided over rechargeable battery 13 via air duct 30*a* extending between inlet check valve 32 and air inlet 30, and thus the air initially cools rechargeable battery 13 until the air enters the interior of drive housing 28.

Due to the alternating positive and negative pressures inside drive housing 28 during the tamping movement of lower mass 2, air is alternately sucked into drive housing 28 via inlet check valve 32 and air inlet 30 and is expelled via air outlet 31 and outlet check valve 33. A constant flow of cooling air inside drive housing 28 can thus be brought about by the pumping movement of lower mass 2.

Figure 9:
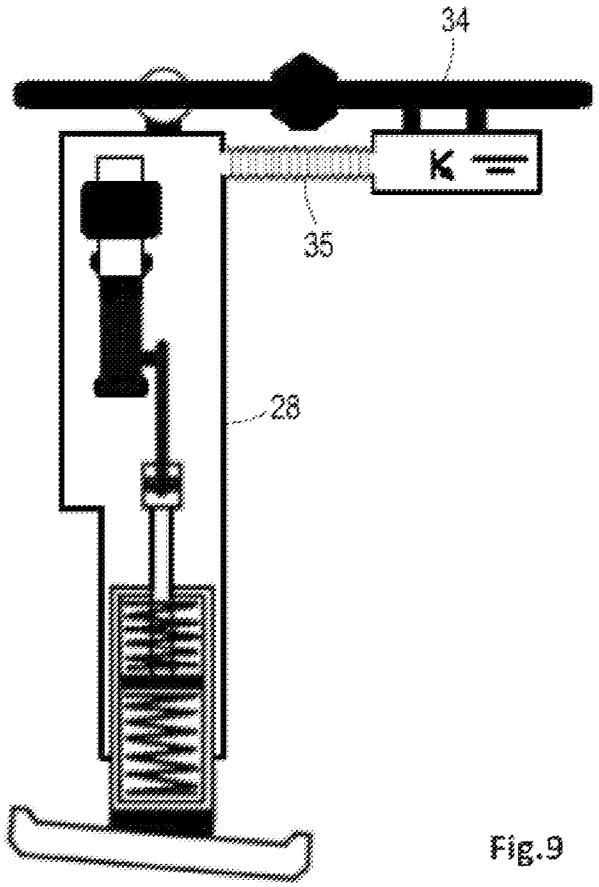
FIG. 9 shows a vibrating tamper with a retractable handle.
Figure 9:
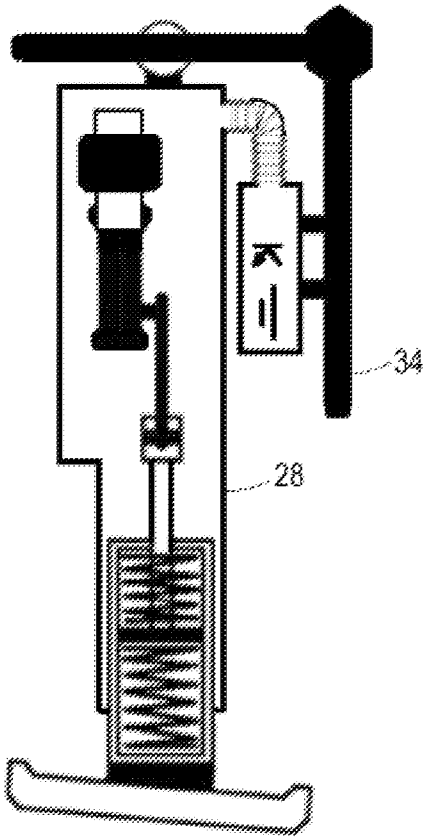

FIG. 9 shows an example of a tamping device according to an embodiment of the invention comprising a retractable handlebar 34, with handlebar 34 depicted in the left-hand part of FIG. 9 in a retracted position, e.g. a particularly compact transport position, while being depicted in the right-hand part of the figure in the unfolded position, namely the operating or working position.

Rechargeable battery 13 can be connected to the drive housing 28 via an elastic hose serving as an air duct 30*a* to enable the flow of cooling air in the manner described above and to allow the handlebar to be unfolded.

Figure 10:
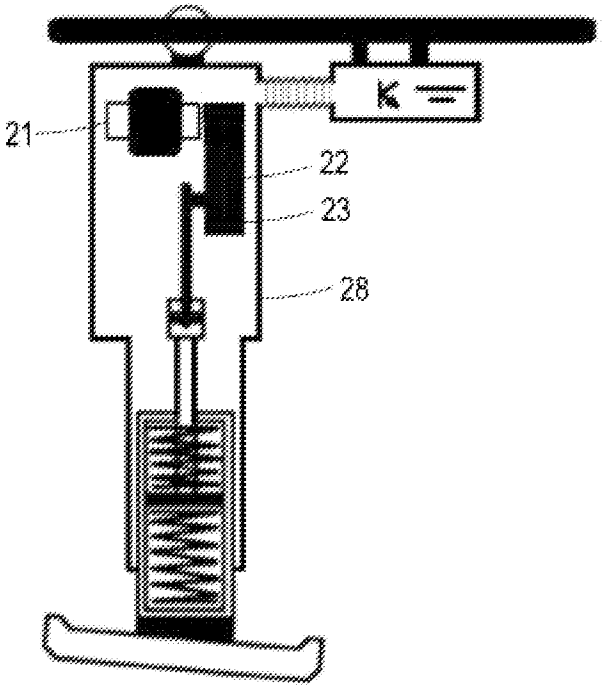
FIG. 10 shows a variant of a vibration tamper according to the invention.
Figure 10:
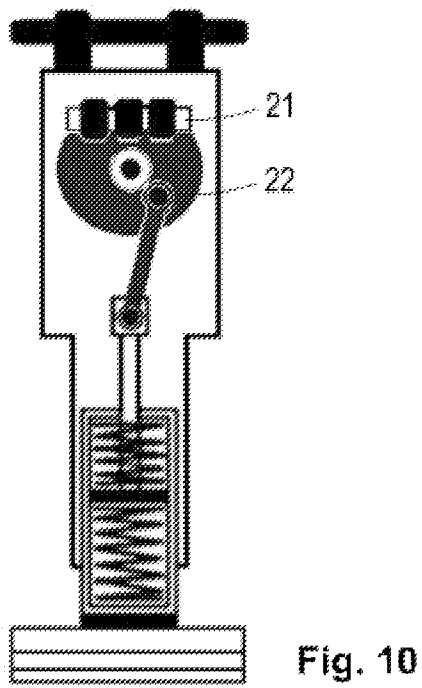

FIG. 10 shows a variant of vibration tamper of FIG. 2. In this case, stator 21 is pivoted by 90° in the direction of the axis of rotation of rotor 22, i.e., relative to rotor 22 and thus also to crank wheel 23. In this way the construction height of drive housing 28 and thus of the entire tamper can be reduced.

Air duct 30*a* extending at least between the housing of rechargeable battery 30 and drive housing 28 should have a certain elasticity in all variants shown, in particular also in the variants of FIGS. 2, 4, 8 and 10, to be able to compensate a relative movement of handle controller 11 carrying rechargeable battery 13 relative to the drive housing 28 of upper mass 1.

The invention claimed is:

1. A soil compacting device, comprising:

an upper mass; and a lower mass which is coupled to the upper mass by a spring and which is movable relative to the upper mass, wherein the lower mass comprises a ground contact element for soil compaction;

wherein a drive for generating a working movement of the ground contact element is provided on the upper mass;

the drive has a tamping device and an electric motor for driving the tamping device;

the tamping device has: a crank wheel that can be driven in rotating manner by the electric motor, a connection rod coupled to the crank wheel, and a tamping piston, which can be moved in a reciprocating fashion, which is coupled to the connection rod, and which interacts with the spring;

the electric motor has a stator and a rotor, wherein the stator encloses the rotor over an angle of less than 360 degrees; and wherein the rotor is rigidly or elastically coupled to the crank wheel.

2. The soil compacting device according to claim 1, wherein the rotor is formed on a circumference of the crank wheel.

3. The soil compacting device according to claim 2, wherein the rotor has a plurality of rotor poles which are arranged on the circumference of the crank wheel.

4. The soil compacting device according to claim 3, wherein the rotor poles are laminated.

5. The soil compacting device according to claim 4, wherein the rotor poles are laminated together with the crank wheel.

6. The soil compacting device according to claim 3, wherein the crank wheel is embodied in non-laminated fashion and carries the laminated rotor poles on its circumference.

7. The soil compacting device according to claim 1, wherein the stator encloses the rotor over an angle of less than 369-180 degrees.

8. The soil compacting device according to claim 1, wherein, in an intended working position of the soil compacting device, the stator is arranged above the rotor.

9. The soil compacting device according to claim 1, wherein at least two crank wheels are provided on a circumference of each a rotor; and wherein the connection rod is driven jointly by the at least two crank wheels.

10. The soil compacting device according to claim 1, wherein at least part of the drive is enclosed by a drive housing; and wherein an air flow generating device is provided for generating a flow of cooling air within the drive housing to cool the rotor and the stator.

11. The soil compacting device according to claim 10, wherein the air flow generating device has at least one of the following operating principles:

by the movement of the tamping piston, an air pump effect can be generated for generating the flow of cooling air;

at least one fan blade is provided on the rotor for generating the flow of cooling air.

12. The soil compacting device according to claim 10, wherein an air inlet for the inflow of air from the environment and an air outlet for releasing air to the environment are provided on the drive housing;

a check valve is provided in the air inlet for setting an air flow direction from the environment into the drive housing; and wherein a check valve is provided in the air outlet for setting an air flow direction from the drive housing into the environment.

13. The soil compacting device according to claim 1, wherein a motor controller is provided for controlling the electric motor in such a way that the speed of the rotor, and thus the speed of the crank wheel, are variable over one or more revolutions of the rotor.

14. The soil compacting device according to claim 1, wherein an uninterrupted circumferential gap extends between opposed ends of an arc formed by the stator.

15. The soil compacting device according to claim 14, the arc length of the gap is more than approximately 180°.

* * * * *